United States Patent [19]

Nakayama et al.

[11] Patent Number: 4,606,405

[45] Date of Patent: Aug. 19, 1986

[54] HEAT TRANSFER WALL

[75] Inventors: Wataru Nakayama, Kashiwa; Tadakatsu Nakajima, Ibaraki; Heikichi Kuwahara, Ibaraki; Akira Yasukawa, Ibaraki; Takahiro Daikoku, Ibaraki; Hiromichi Yoshida, Hitachi, all of Japan

[73] Assignees: Hitachi, Ltd.; Hitachi Cable, Ltd., both of Tokyo, Japan

[21] Appl. No.: 701,161

[22] Filed: Feb. 13, 1985

[30] Foreign Application Priority Data

May 11, 1984 [JP] Japan ..... 59-92859

[51] Int. Cl.[4] ..... F28F 13/02

[52] U.S. Cl. ..... 165/133; 62/527

[58] Field of Search ..... 62/527; 165/133

[56] References Cited

U.S. PATENT DOCUMENTS

| | | | |
|---|---|---|---|
| Re. 30,077 | 8/1979 | Kun et al. | 165/133 |
| 3,566,514 | 3/1971 | Szumigala | 165/133 X |
| 4,059,147 | 11/1977 | Thorne | 165/133 |
| 4,168,743 | 9/1979 | Arai et al. | 165/133 |
| 4,216,826 | 8/1980 | Fujikake | 165/133 |
| 4,434,842 | 3/1984 | Gregory | 165/133 |
| 4,458,748 | 7/1984 | Yamada et al. | 165/133 |

*Primary Examiner*—Sheldon J. Richter

*Attorney, Agent, or Firm*—Antonelli, Terry & Wands

[57] ABSTRACT

In a perforated heat conductive surface structure having voids under an outer surface and openings in the outer surface, in order to obtain a high performance in particular at a low pressure and low temperature region, there is provided a heat transfer wall in which a thickness of a wall at a ceiling of each void and a length of a passage of the respective openings are increased in predetermined ranges.

1 Claim, 12 Drawing Figures

HEAT TRANSFER WALL

BACKGROUND OF THE INVENTION

1. Field of the Invention

The present invention relates to a heat transfer wall for transferring heat by phase-conversion of liquid which is in contact with an outer surface of a planar plate or a heat transfer tube, and more particularly, to a heat transfer surface for use with an evaporator or a radiator.

2. Description of the Prior Art

There have been proposed various techniques concerning heat transfer walls or surfaces for enhancing boiling or evaporation heat transfer performance.

For instance, there is a method wherein an outer surface of a heat transfer wall is formed into a porous layer by sintering, weld-spraying, edging or the like. Such a heat transfer surface has a higher heat transfer performance than that of a planar and smooth surface. However, since voids in the porous layer are small, impurities contained in the boiling liquid or non-boiling liquid per se would clog the voids so that its heat transfer performance would deteriorate. Also, since the voids formed in the porous layer are made non-uniform in size, a heat transfer performance at some places are different from that at other places.

On the other hand, as shown in U.S. Pat. No. 4,060,125, there is disclosed a heat transfer wall having tunnels, openings and upper lids on a heat transfer surface. This heat transfer wall has a higher heat transfer performance. The openings are large in size in comparison with the porous layer formed by sintering. Therefore, a reduction in performance due to the clogging of impurities or non-boiling liquid may be suppressed. However, in the heat transfer wall having the opening and tunnels, there is an optimum opening diameter corresponding to a thermal load imposed on the heat transfer surface. Therefore, if the thermal load is too small or large the heat transfer performance will be lowered.

In particular, the heat transfer coefficient is lowered at a lower heat flux (for example, $dw<2$ W/cm$^2$ in R-11). This tendancy becomes more remarkable as a pressure is decreased, for example, to $P_s=0.04$ MPa. Such a problem that the performance is degraded under the low heat flux and low pressure condition has been encountered also in a heat transfer surface having another porous structure (for example, metal particle sintered surface), which becomes a serious industrial problem.

On the other hand, Japanese Patent Application Laid-Open No. 14260/77 discloses a heat transfer structure in which, instead of limiting a size of the openings, by increasing a depth of the holes, the coolant is heated by the surrounding surface while passing through the passage of the holes, to be blown outside as bubbles. In such a heat transfer wall structure, since the size of the openings is not limited as shown in the specific embodiment thereof, there is no effect of replenishing the inside of the tunnels with vapor bubbles but a siphon effect obtained by the passages formed of the tunnels and the long holes is accelerated as well as the acceleration of heating and vaperization of the coolant with the long or deep holes. Accordingly, even with such a heat transfer wall structure, it is impossible to satisfactorily increase the heat transfer coefficient, in particular, under the low heat flux and the low pressure.

Also, Japanese Patent Application Laid-Open No. 45353/76 proposes a heat transfer wall characterized in that, in a boiling heat transfer surface having voids, under the outer surface, communicating with the outside through narrow openings adjacent to fins, a relationship of $S.L/D \leqq 3$ ($D \leqq 0.12$) where D (mm) is the width of the openings, L (mm) is the depth of the openings, and S (mm$^2$) is the cross-sectional area of the voids. The outer surface of that structure has a boiling heat transfer rate twice as large as that of the smooth tube or more. However, such a proposal is related to the optimum dimensional relationship of the heat transfer surface having the continuous slit-like openings. With such a heat transfer surface, it is still impossible to solve the following problems. Namely, the location from which the bubbles through the voids and into which the liquid is supplied is not fixed and the vapor bubbles in the voids exist in an unstable fashion. Also, a great amount of liquid enters into the voids under the low heat flux and the low pressure. Thus, the heat transfer rate is extremely decreased.

SUMMARY OF THE INVENTION

An object of the present invention is to provide a heat transfer wall having a structure capable of effectively achieve phase-conversion of liquid and having a high heat transfer performance at a low heat flux or a low saturation pressure.

The present invention is characterized in that, in a heat transfer wall having restricted openings and voids, the voids are provided at locations remote from the outer surface of the heat transfer wall structure. In other words, a thickness of lid members partitioning the voids and the heat transfer wall is increased and at the same time a length of passages (for boiling liquid and vapor) extending from the voids to the outer surface of the heat transfer wall is elongated within a predetermined range.

DETAILED DESCRIPTION OF THE PREFERRED EMBODIMENTS

Figure 1:
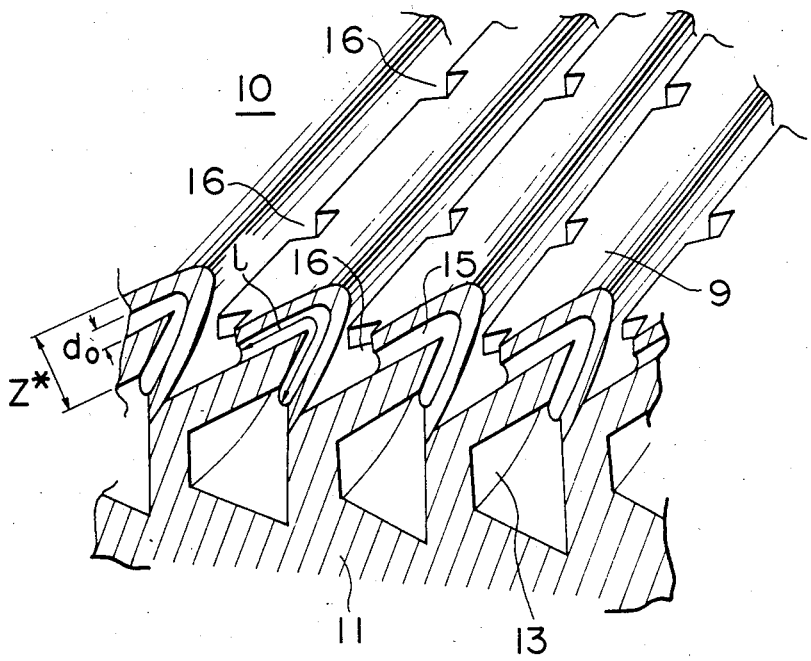
FIG. 1 is a perspective view of a heat transfer wall in accordance with an embodiment of the invention.

A first embodiment of the invention will now be described with reference to FIG. 1.

In an outer layer 11 of a heat transfer wall, a number of elongated tunnel-like voids 13 are provided in parallel. The voids 13 are communicated with an outer surface 10 of the heat transfer wall through restricting openings 16 and elongated tubular passages each having a cross-sectional area smaller than a maximum cross-sectional area of each of the voids 13. In each of upper lids 9, the elongated tubular passages 15 and the restricting openings 16 are formed at a constant interval along the tunnels. It is apparent that transverse cross-sections of the voids 13, the elongated tubular passages 15 and the restricting openings 16 are not always limited to those shown in the embodiment. As desired, it is possible to select shapes from circular, polygonal, rectangular, and elliptic shapes. However, it is to be noted that in any case, the maximum cross-sectional area of each of the voids 13 should be greater than the cross-sectional area of each of the passages 15 or the restricting openings 16.

Figure 2:
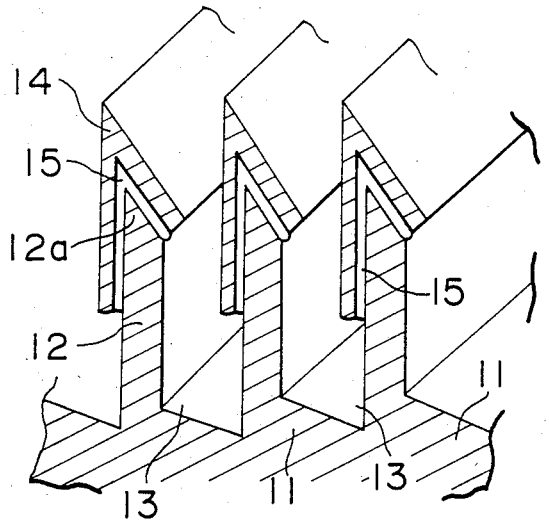
FIGS. 2 and 3 are views showing a method for producing the heat transfer wall shown in FIG. 1.
Figure 3:
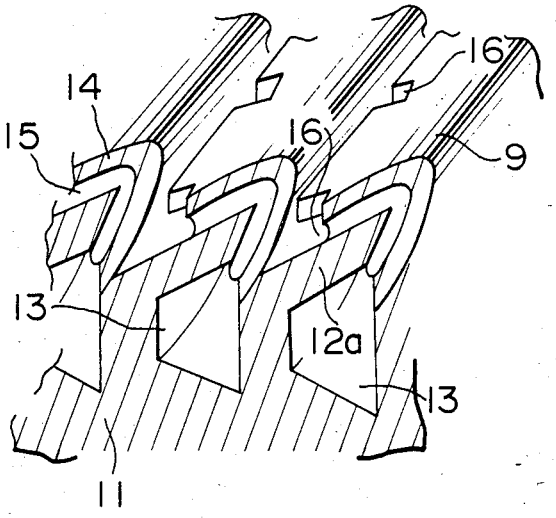

The heat transfer wall shown in FIG. 1 may readily be produced as described below. As shown in FIG. 2, V-shaped plates 14 having a number of elongated grooves 15 substantially parallel to each other are laid on edge portions 12*a* of a number of fins 12 raised from the outer layer 11 of the heat transfer wall. These plates 14 become the upper lids 9 and are made of the same material as that of the outer layer 11. Subsequently, as shown in FIG. 3, the fin edges 12*a* of the outer layer 11 of the heat transfer wall covered by the V-shaped plates 14 are bent by, for example, rollers into or above the grooves 13 defined by the adjacent fins, thereby obtaining the heat transfer wall shown in FIG. 1.

Figure 4:
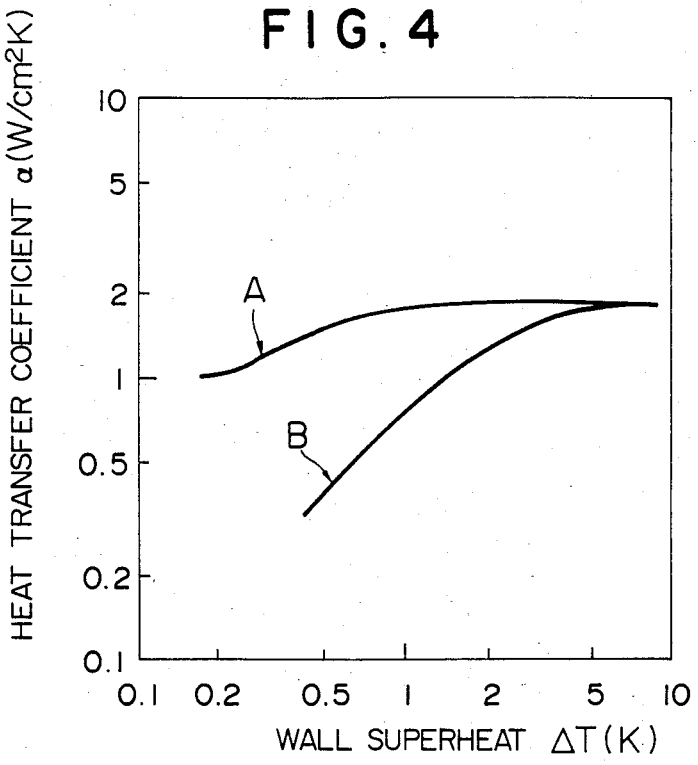
FIG. 4 is a graph showing characteristics of heat transfer coefficient of the embodiment shown in FIG. 1.
Figure 5:
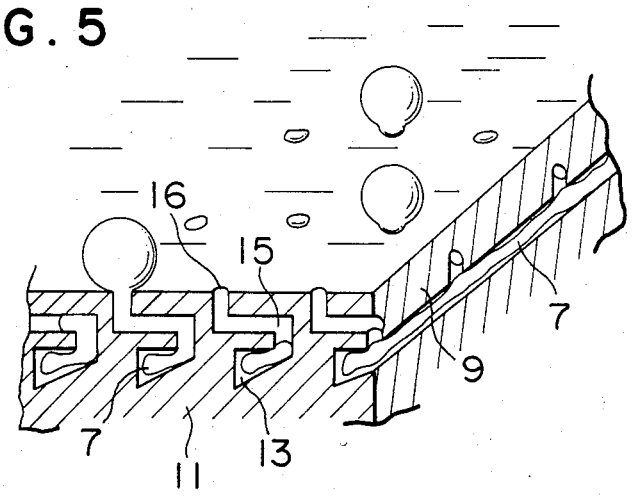
FIG. 5 is a view illustrating an effect of the embodiment shown in FIG. 1.

FIG. 4 shows heat transfer characteristics of the heat transfer wall in accordance with the present invention. In this case, the material of the heat transfer wall was copper, the opening diameter $d_o$ was 0.02 cm, the thickness Z* of the upper lid was 0.1 cm, the length l of the boiling liquid and steam passage from the void to the outer surface of the heat transfer wall was 0.1 cm, and the void was a rectangular shape of 0.025 cm×0.04 cm. These performance curves in FIG. 4 were obtained in $CFCl_3$ (Freon R-11) at the saturated pressure of 0.04 MPa. In FIG. 4, the ordinate represents the heat transfer rate ($W/cm^2K$), the abscissa represents the heat flux ($W/cm^2$), denotes the characteristics in accordance with the present invention and B denotes the characteristics in accordance with the prior art (where the upper lid thickness Z* was 0.01 cm). In particular, at a low heat flux below 1 $W/cm^2$, the heat transfer wall according to the present invention has a heat transfer performance three times as large as that of the conventional heat transfer wall or more. This is due to the fact that, as shown in FIG. 5, thin films 7 of liquid are always maintained inside of the voids 13 so that even at a low pressure and a low heat flux, a higher heat transfer performance may be obtained in accordance with the invention.

Figure 6:
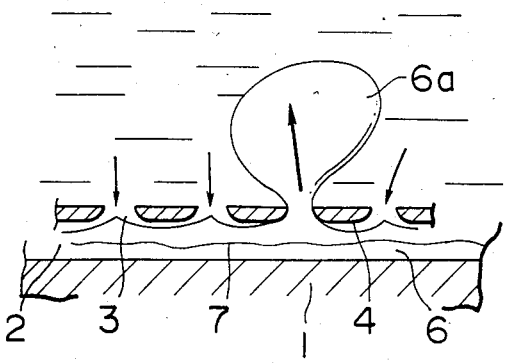
FIGS. 6 and 7 are other views illustrating the effect of the embodiment shown in FIG. 1.
Figure 7:
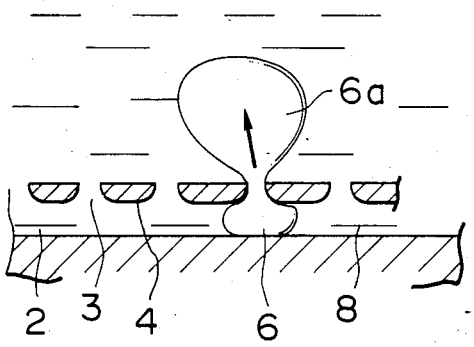

According to a visual experiment conducted by the present inventors in which the insides of the voids of a heat transfer wall having the voids and openings connected as shown in U.S. Pat. No. 4,060,125 were made visible, when the heat transfer wall was heated at a relatively high temperature by liquid which contacted with the heat transfer wall, vapor bubbles 6 were generated in the voids 2 as shown in FIG. 6 (referred to as an E mode), and a part of the vapor bubbles was discharged to the outside of the heat transfer wall as bubbles 6*a*. Such a phenomenon was observed. Also, it was observed that in the voids 2, the vapor bubbles 6 pushed the liquid contained in the void toward the inner wall of the voids so that a thin liquid film 7 was formed in the inner wall of the voids. On the other hand, as the degree of superheating of the wall surface was gradually decreased from the state shown in FIG. 6, the part of the vapor bubble 6 contained in the voids 2 was shrunk as shown in FIG. 7. As a result, liquid 8 existed between the vapor bubbles (F-mode). Such a result was confirmed.

In the heat transfer wall having the voids 2 and the openings 3 connected to each other, the thin liquid film 7 adhered to the void inner walls as shown in FIG. 6 was evaporated by a smaller degree of superheating, and therefore, had a higher evaporation heat transfer rate. This effect might ensure a high heat conductive performance. However, under the condition that the thermal load was small and the wall surface superheat was small, that is, in the F-mode in which a great amount of liquid entered into the voids and an area occupied by the thin liquid film was decreased, it was impossible to obtain a higher heat transfer performance.

The present inventors have studied the appearance of the F-mode and have found the following two causes. Namely, (A) shrinkage of a vapor bubble due to the fact that in accordance with discharge of a bubble 6*a*, the outside boiling liquid 8 kept at a lower temperature washes the upper lid 4 of the upper portion of the voids to locally cool the upper lid so that the vapor bubble 6 in the voids is condensed by the cooled lid 4; and (B) shrinkage of vapor bubble 6 due to the fact that the vapor bubble is condensed into the boiling liquid 8, kept at a lower temperature, sucked into the voids 2 from the openings 3 are found.

The condensation onto the upper lid 4 as described in the cause (A) may be prevented by increasing the upper lid thickness Z* shown in the foregoing embodiment. Namely, the appearance of the lower temperature liquid in the outer surface of the heat transfer wall is in synchronism with the discharge cycle of the bubble 6. The low temperature propagates in the thickness direction of the upper lid 4 (from the outer surface to the voids) through heat conduction while being attenuated.

The temperature difference $\Delta\theta(Z)$ between the temperature in the upper lid at any depth from the outer surface and the saturated temperature of the boiling liquid is represented by using an error function erf as follows:

$$\frac{\Delta\theta(Z)}{\Delta Tw} = erf\left(\frac{Z}{2\sqrt{a_w\tau}}\right) \quad (1)$$

where $a_w$ ($cm^2/s$) is the thermal diffusing of the heat transfer wall, $\tau$(s) is time measured from the instant when the low temperature liquid touches the outer surface of the heat transfer wall, Z (cm) is the distance from the outer surface of the heat transfer wall to the voids, and $\Delta Tw$ is superheating degree of the heat transfer wall.

On the other hand, the degree of the wall superheat is decomposed into a temperature decrease $\Delta T_l$ in the liquid film adhered to the void inner wall and a degree of superheat $\Delta T_b$ required for forming bubbles at the openings. When the temperature difference $\Delta\theta$ on the void wall ($Z=Z^*$) decreases below $\Delta T_b$, it is impossible to form the bubbles at the openings. As a result, a remarkable condensation is caused to thereby shrink the bubbles of vapor within the voids. Namely, the condition for stable existance of bubbles within the voids is expressed as follows:

$$\mathrm{erf}\left(\frac{Z^*}{2\sqrt{a_w\tau}}\right) \geqq \frac{\Delta T_b}{\Delta T_l + \Delta T_b} \tag{2}$$

where $$\Delta T_b = \frac{T_s}{\rho_v \cdot h_{fg}} \cdot \frac{4\sigma}{d_O} \cdot 10^{-7}$$

$$\Delta T_l = \frac{\delta \cdot q_w}{\phi\lambda_l}$$

$a_w$: thermal diffusing of the heat transfer wall ($cm^2/s$),
$T_s$: saturation temperature of the boiling liquid (K),
$\pi_v$: density of the boiling liquid ($g/cm^3$),
$h_{fg}$: evaporation latent heat of the boiling liquid (J/g),
$\sigma$: surface tension of the boiling liquid (dyn/cm),
$\lambda_l$: thermal conductivity of the boiling liquid (w/Kcm),
$d_O$: diameter of opening (cm),
$\theta$: rato of the surface area of the void to the projected area of the heat transfer wall,
$Z^*$: thickness of the upper lid (cm),
$\delta$: thickness of the liquid film on the void surfaces (cm), and
$q_w$: heat flux ($w/cm^2$).

In accordance with the experiments conducted by the present inventors, the time period $\pi$ in the condition (2) was about 0.02 sec. in an actual heat flux range although the period of time $\tau$ would be determined by a function of the heat flux. Also, $\delta \div 0.002$ (cm) and $\sigma = 3$ were determined.

By substituting the values by the above-described experimental values in the condition (2) and then seeking a numerical expression, the following relationship is obtained:

$$erf\left(\frac{Z^*}{2\sqrt{C_\tau a_w}}\right) \geqq \frac{4 \cdot T_s \cdot \sigma \cdot \lambda_l \times 10^{-7}}{C_q \cdot q_w \cdot \rho_v \cdot h_{fg} \cdot d_O + 4T_s \cdot \lambda_l \cdot \sigma \times 10^{-7}} \tag{2'}$$

where $C_\tau = 0.02$ and $C_q = 0.00067$.

Therefore, in the case where the Freon gas $CFCl_3$ is used under the condition of Ts=273(K), a minimum upper lid thickness required for the heat transfer wall having an opening diameter of 0.02 cm and made of copper is 0.073 cm.

The condensation of the boiling liquid, kept at a lower temperature than that on the outer surface of the heat transfer wall described above in conjunction with the cause (B), may be prevented by elongating the passage l of liquid and heating the liquid in this passage. According to the visual experiments conducted by the inventors, the suction of the liquid was remarkable at the active opening where bubbles are formed and other pores nearby opening including the opening where the vapor bubble was actually generated and the adjacent openings thereto. It was also confirmed that the suction of the liquid was not remarkable in the other openings.

Therefore, the condition that the liquid sucked from the above-described the active opening where babbles are formed and other pores nearby openings is heated to the temperature of the heat transfer wall while the liquid passes through the passages is expressed as follows:

$$\left.\begin{aligned} l &\geqq C_h \cdot \frac{q_w}{h_{fg}} \cdot \frac{1}{N_A/A} \cdot C_{pl} \cdot \frac{1}{\lambda_l} \\ N_A/A &= C_b \cdot d_O^{0.4} \cdot q_w^{0.5} \end{aligned}\right\} \tag{3}$$

where
l: length of the passages (cm),
$q_w$: heat flux ($w/cm^2$),
$h_{fg}$: boiling latent heat of the liquid (J/g),
$C_{pl}$: specific heat of the boiling liquid (J/g.K),
$\lambda_l$: thermal conductivity of the boiling liquid (w/cm.K),
$N_A/A$: number density of bubble formation sites point ($1/cm^2$),
$d_O$: diameter of opening (cm), and
$C_b$: constant (Freon; $C_b=80$, $N_2$; $C_b=80$, and $H_2O$; $C_b=95$)
$C_h$: 0 058
The boiling liquid is $CFCl_3$,
q: 1 $w/cm^2$, and
$d_O$: 0.01.

These values are effected in the relationship (3) to thereby obtain the relationship of $l \geqq 0.022$ (cm).

On the other hand, if the passages are elongated, a fluid resistance of the vapor is increased upon the discharge of the vapor to the outside of the heat transfer wall. Therefore, there is an upper limit to the length l of the passages. A loss of pressure in the passage should be lower than a maximum vapor pressure in the voids. The condition therefor is given as follows:

$$l \leqq C_f \cdot d_O^3 \cdot \frac{1}{\nu_v} \cdot \frac{h_{fg}}{q_w} \cdot \frac{N_A}{A} \cdot \sigma \tag{4}$$

where $\nu_v$ is the dynamic viscosity coefficient ($cm^2/s$) and $C_f$ is 0.098.

If the condition (4) is solved under the same condition as that of the condition (3), $l \leqq 0.12$ (cm).

In Table 1, the cases where the liquids are $CFCl_3$(R-11), $C_2Cl_3F_3$(R-113) and $C_2Cl_2F_4$(R-114) are shown.

TABLE 1

| | Z* and l in case of Freon | | | (in cm) |
|---|---|---|---|---|
| do | 0.01 | 0.015 | 0.02 | |
| | | (a) copper | | |
| $CFCl_3$ | | $0.087 \leqq Z^* \leqq 0.48$ | $0.073 \leqq Z^* \leqq 1.27$ | |
| | | $0.019 \leqq l \leqq 0.48$ | $0.017 \leqq l \leqq 1.27$ | |
| $C_2Cl_3F_3$ | | $0.15 \leqq Z^* \leqq 0.22$ | $0.12 \leqq Z^* \leqq 0.59$ | |
| | | $0.030 \leqq l \leqq 0.22$ | $0.027 \leqq l \leqq 0.59$ | |
| $C_2Cl_2F_4$ | $0.045 \leqq Z^* \leqq 0.15$ | $0.34 \leqq Z^* \leqq 0.59$ | $0.03 \leqq Z^* \leqq 1.57$ | |
| | $0.054 \leqq Z^* \leqq 0.15$ | $0.043 \leqq l \leqq 0.59$ | $0.038 \leqq l \leqq 1.57$ | |

TABLE 1-continued

| | Z* and l in case of Freon | | | (in cm) |
|---|---|---|---|---|
| do | 0.01 | 0.015 | 0.02 | |
| | | (b) aluminum | | |
| $CFCl_3$ | $0.10 \leqq Z^* \leqq 0.12$ | $0.072 \leqq Z^* \leqq 0.48$ | $0.061 \leqq Z^* \leqq 1.27$ | |
| | $0.022 \leqq l \leqq 0.12$ | $0.019 \leqq l \leqq 0.48$ | $0.017 \leqq l \leqq 1.27$ | |
| $C_2Cl_3F_3$ | | $0.12 \leqq Z^* \leqq 0.22$ | $0.10 \leqq Z^* \leqq 0.59$ | |
| | | $0.030 \leqq l \leqq 0.22$ | $0.027 \leqq l \leqq 0.59$ | |
| $C_2Cl_2F_4$ | $0.04 \leqq Z^* \leqq 0.15$ | $0.03 \leqq Z^* \leqq 0.59$ | $0.02 \leqq Z^* \leqq 1.57$ | |
| | $0.054 \leqq l \leqq 0.15$ | $0.043 \leqq l \leqq 0.59$ | $0.038 \leqq l \leqq 1.57$ | |
| | | (c) cupro-nickel | | |
| $CFCl_3$ | $0.028 \leqq Z^* \leqq 0.11$ | $0.02 \leqq Z^* \leqq 0.48$ | $0.017 \leqq Z^* \leqq 1.27$ | |
| | $0.022 \leqq l \leqq 0.11$ | $0.019 \leqq l \leqq 0.48$ | $0.017 \leqq l \leqq 1.27$ | |
| $C_2Cl_3F_3$ | $0.044 \leqq Z^* \leqq 0.056$ | $0.034 \leqq Z^* \leqq 0.22$ | $0.028 \leqq Z^* \leqq 0.59$ | |
| | $0.035 \leqq l \leqq 0.056$ | $0.030 \leqq l \leqq 0.22$ | $0.027 \leqq l \leqq 0.59$ | |
| $C_2Cl_2F_4$ | $0.01 \leqq Z^* \leqq 0.15$ | $0.008 \leqq Z^* \leqq 0.59$ | $0.006 \leqq Z^* \leqq 1.57$ | |
| | $0.054 \leqq l \leqq 0.15$ | $0.043 \leqq l \leqq 0.59$ | $0.038 \leqq l \leqq 1.57$ | |

Figure 8:
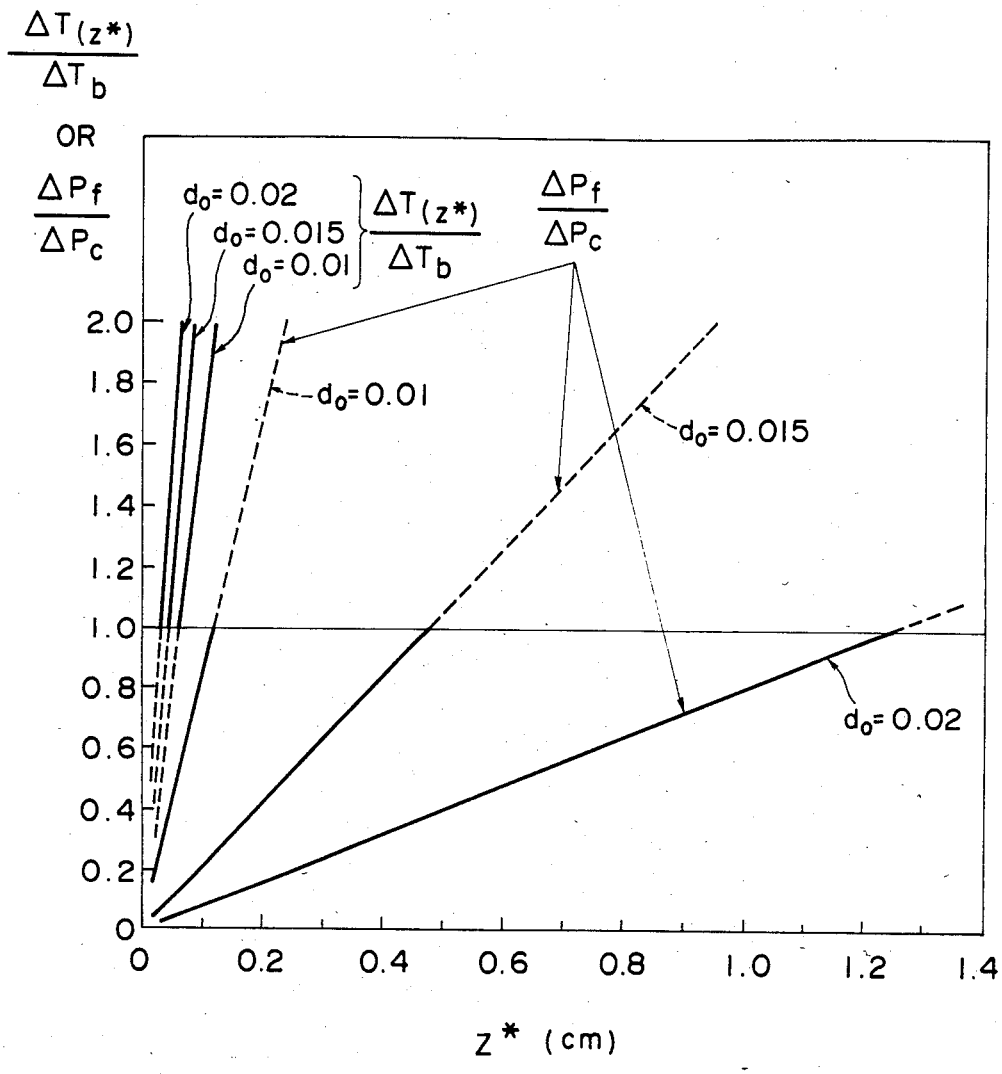
FIG. 8 is a graph showing a range of the thickness Z* of lid members in accordance with the invention.
Figure 9:
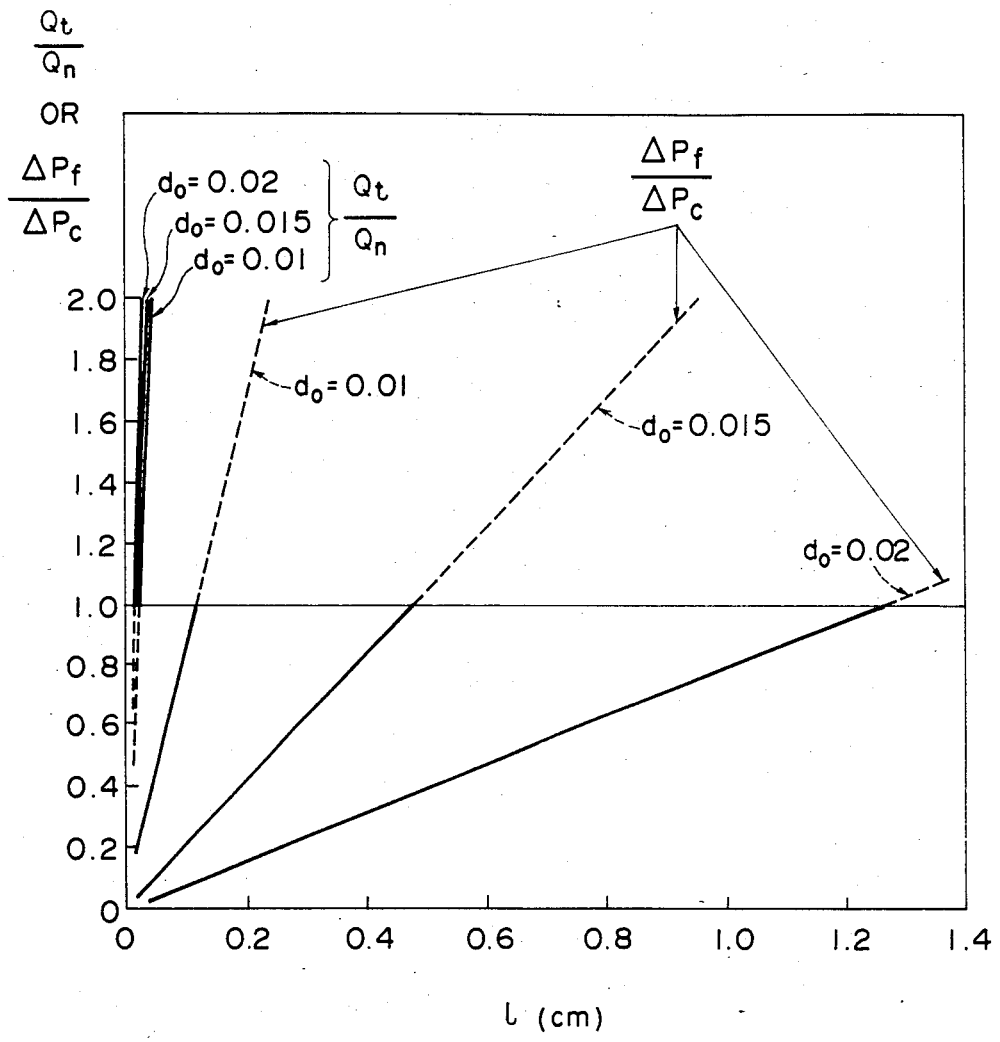
FIG. 9 is a graph showing a range of the passage length l similarly in accordance with the invention.

The ranges of Z* and l under the condition that the heat transfer wall is made of copper and the boiling liquid $CFCl_3$ (R-11) is in the boiling liquid saturation temperature of 273 (K) are shown in FIGS. 8 and 9, respectively. In FIG. 8, $\Delta T(Z^*)$ is the superheat of the surface temperature of the voids on their ceiling wall side and $\Delta T_b$ is the superheat of the vapor bubble. In order to prevent the vapor bubbles in the voids from being condensed or shrunk, the relationship, $\Delta T(Z^*) \geqq \Delta T_b$, should be established. Therefore, unless the value of Z* meet the range of $$\frac{\Delta T(Z^*)}{\Delta T_e} \geqq 1,$$

it is impossible to maintain the thin liquid film on the wall of the voids.

$\Delta P_f$ is the loss of vapor pressure at the opening $\Delta P_c$ is the maximum pressure difference inside and outside the vapor bubbles. If the relationship of $\Delta P_f > \Delta P_c$ is given, it is necessary to keep the vapor bubbles in the voids at $\Delta P_f$. In this case, a larger superheat is required. Therefore, Z* must be selected from the range of $\Delta P_f/\Delta P_c \leqq 1$. In FIG. 9, $Q_t$ is the heat transfered at the openings and $Q_n$ is the heat transfer rate required for the liquid outside of the heat transfer wall being elevated to the temperature of the openings. If the relationship of $Q_t < Q_n$ is given, the liquid at a temperature lower than the temperature in the void enters into the voids. As a result, the vapor bubbles within the voids are cooled to be condensed or shrunk. Therefore, l must be selected from the range of $Q_t/Q \geqq 1$. Also, as explained above in conjunction with FIG. 8, it is necessary to select l in the range of $\Delta P_f/\Delta P_c \leqq 1$.

Figure 10:
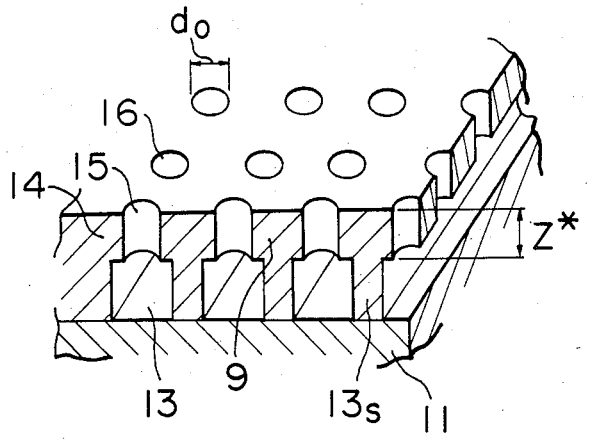
FIG. 10 is a perspective view showing another embodiment of the invention.

In another embodiment shown in FIG. 10, a number of elongated voids 13 and partitioning walls 13*s* are formed in parallel with each other in an outer layer 11 of the heat transfer wall. In an upper lid 9 of the voids 13, at a predetermined interval along the longitudinal direction of the voids 13, there are formed a number of passages 15 having restricted openings 16 for restricting a maximum cross-sectional area of the voids 13 and for communicating the voids 13 with the outside of the heat transfer wall. Dimensions and pitches of the voids 13, the restricted openings 16, the passage 15 and the upper lid 9 are arbitrarily selected from the numerical ranges described before. It is apparent that the transverse cross-sectional forms of the voids 13, the restricted openings 16 and the passages 15 are not necessarily limited to those shown in the embodiment. The forms thereof may be selected from circular, polygonal, rectangular and elliptical ones, as desired.

However, in any case, the maximum cross-sectional area of the voids 13 should be greater than the cross-sectional area of the restricted openings 16.

Figure 11:
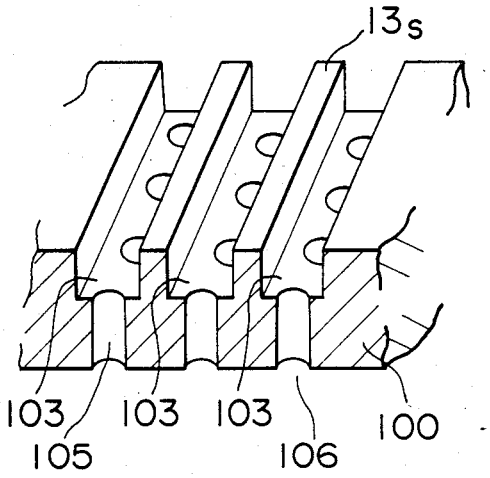
FIG. 11 is a view illustrating a method of producing the heat transfer wall shown in FIG. 10.

The heat transfer wall shown in FIG. 10 may readily be produced in the following manner. First of all, a number of elongated grooves 103, partitioned by the side walls 13*s*, are formed in a plate 100, to become the outer layer of the heat transfer wall, by mechanical cutting process or groove forming process as shown in FIG. 11. Along the bottoms of the elongated grooves, the openings 106 passing through the plate and the passages 105 are formed at predetermined intervals. Upon forming the grooves in the plate 100, the openings 105 and the passages 106 may be formed in a single machining process. Also, the formation of the openings 106 and the passage 105 may be carried out by a general chemical corrosion process, laser beam machining or electron beam machining. The grooved plate 100 having the number of grooves 103, openings 106 and passages 105 is brought into intimate contact with or bonded to a base surface of the heat transfer wall to thereby produce the heat transfer wall structure according to the present invention.

Figure 12:
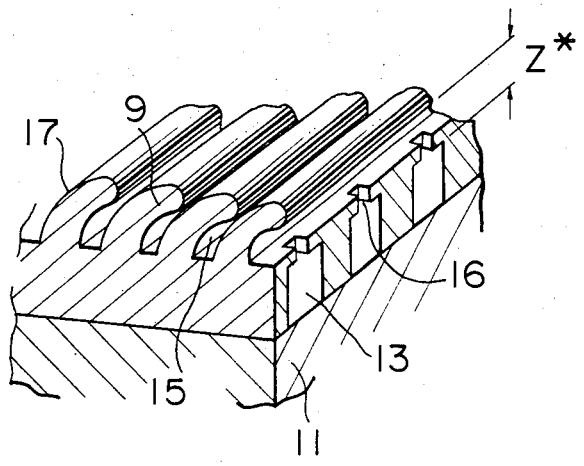
FIG. 12 is a perspective view showing still another embodiment of the invention.

In another embodiment shown in FIG. 12, a number of elongated tunnel-like voids 13 are formed substantially in parallel with each other in an outer layer 11 of the heat transfer wall. In addition, a number of curved fins 17 which are substantially in parallel with each other are formed on the outer surface of the heat transfer wall in a direction intersecting the direction of the tunnel-like voids 13. The voids 13 and the outer surface of the heat transfer wall are communicated with each other through openings 16 and thin slit-like passages 15 having a cross-sectional area smaller than a maximum cross-sectional area of the voids. The above-described curved fins 17 restrict the cross-section of the slit-like passage 15. The cross-section of the slit-like passages 15 is restricted by narrowing the pitch of the fins 17 to obtain the same effect. The heat transfer wall may be obtained in the following manner. First of all, a number of grooves substantially in parallel with each other are formed in a metal plate from its top and bottom surfaces, respectively, so that the grooves formed on the top side are intersected with the grooves formed on the bottom side. Subsequently, portions having a thin thickness at the intersections of the top and bottom grooves are removed by etching or the like to form holes. Otherwise, if a cutting machining, an electric discharge machining or the like is used as the groove forming process, it is possible to increase the sum of depths of the top and bottom grooves more than the original thickness of the metal plate, to thereby enable to dispense with the process such as etching. Subsequently, the thus obtained perforated plate having the intersecting top and bottom grooves are brought into intimate contact with or bonded to the base surface of the heat transfer wall, and then the fins extending from the outer surface are bent by rolling or the like to thereby obtain the heat transfer wall structure according to the present invention.

What is claimed is:

1. A heat transfer wall comprising a number of elongated voids formed in an outer layer of said heat transfer wall, upper lids forming a part of said heat transfer wall for partitioning said voids and an outer surface of said heat transfer wall, passages for communicating the respective voids and the outer surface of said heat transfer wall with each other, and restricted openings formed in said passages, said restricted openings having a cross-sectional area smaller than a maximum cross-sectional area of said voids and being independent of each other, and said heat transfer wall being made of a single kind of heat conductive material, wherein a thickness of said upper lids defined by a distance Z* (cm) between an upper end of each of said voids and the outer surface of said heat transfer wall and a length l (cm) of each of said passage extending from said voids to the outer surface of said heat transfer wall simultaneously meet the following condition in combination of the material of said heat transfer wall and a fluid flowing on said heat transfer wall:

$$\begin{cases} erf\left(\dfrac{Z^*}{2\sqrt{C_\tau a_w}}\right) \geqq \dfrac{4Ts\cdot\sigma\cdot\lambda_l\times 10^{-7}}{C_q\cdot q_w\cdot\rho_v\cdot h_{fg}\cdot d_O+4Ts\cdot\sigma\cdot\lambda_l\times 10^{-7}} \\ Z^* \leqq C_f\cdot d_O^3\cdot\dfrac{1}{\nu_v}\cdot\dfrac{h_{fg}}{q_w}\cdot\dfrac{N_A}{A}\cdot\sigma, \text{ and} \end{cases}$$

$$\begin{cases} l \geqq C_h\cdot\dfrac{q_w}{h_{fg}}\cdot\dfrac{A}{N_A}\cdot C_{pl}\cdot\dfrac{1}{\lambda_l} \\ l \leqq C_f\cdot d_O^3\cdot\dfrac{1}{\nu_v}\cdot\dfrac{h_{fg}}{q_w}\cdot\dfrac{N_A}{A}\cdot\sigma \end{cases}$$

where erf is the error function erf $$(\beta) = \frac{2}{\sqrt{\pi}} \quad {}_o^{\beta} e^{-\xi^2} d\xi;\ a_w$$

is the thermal diffusivity of the heat transfer wall ($cm^2$/sec); Ts is the saturation temperature of the boiling liquid (K); $\sigma$ is the surface tension of the boiling liquid (dyn/cm); $\lambda_l$ is the thermal conductivity of the boiling liquid (W/kcm); $\theta_v$ is the density of vapor of the vapor (g/$cm^3$); $h_{fg}$ is the evaporation latent heat of the boiling liquid (J/g); $\nu_v$ is the dynamic viscosity coefficient of the vapor ($cm^2$/sec); $d_o$ is the diameter of the restricted openings (cm); $q_w$ is the heat flux based on the projected area (W/$cm^2$); $N_A/A$ is the number density of bubbling points ($N_A/A = C_b\cdot d_o^{0.4}\cdot q_w^{0.5}$ where $C_b=80$ in case of Freon or liquefied nitrogen, and $C_b=95$ in case of water); and $C_\tau$, $C_q$, $C_f$ and $C_h$ are the constants determined by physical characteristics of the boiling liquid, where $C_\tau \div 0.02$, $C_q \div 0.0007$, $C_f \div 0.1$ and $C_h \div 0.06$.

* * * * *